US005819498A

United States Patent [19]

Geraci

[11] Patent Number: 5,819,498

[45] Date of Patent: Oct. 13, 1998

[54] HOME CONSTRUCTION METHODOLOGY

[76] Inventor: Joseph R. Geraci, 8156 Devonshire Pl., Maineville, Ohio 45039

[21] Appl. No.: 741,390

[22] Filed: Oct. 29, 1996

[51] Int. Cl.[6] ..... E04B 2/28

[52] U.S. Cl. ..... 52/745.1; 52/475.1; 52/481.1; 52/745.19; 52/745.2; 52/779; 52/793.11; 33/562; 269/910

[58] Field of Search ..... 52/475.1, 481.1, 52/778, 779, 309.7, 793.11, 745.19, 745.2, 745.1; 33/562; 269/910

[56] References Cited

U.S. PATENT DOCUMENTS

| | | | |
|---|---|---|---|
| 2,103,152 | 12/1937 | Douglass . | |
| 2,262,827 | 11/1941 | Wilson, Jr. et al. . | |
| 2,305,124 | 12/1942 | Wilson, Jr. et al. . | |
| 2,322,368 | 6/1943 | Lacey . | |
| 2,495,862 | 1/1950 | Osborn . | |
| 2,626,643 | 1/1953 | Kantzler . | |
| 2,662,565 | 12/1953 | Levay . | |
| 2,749,873 | 6/1956 | Huffman . | |
| 2,754,862 | 7/1956 | Kemp, Jr. . | |
| 2,766,488 | 10/1956 | Danielson . | |
| 2,810,414 | 10/1957 | Wilson . | |
| 2,822,841 | 2/1958 | Huffman . | |
| 3,036,609 | 5/1962 | Quesenberry, Jr. . | |
| 3,299,920 | 1/1967 | Koenigshof . | |
| 3,699,736 | 10/1972 | Wallace . | |
| 3,811,167 | 5/1974 | Schneider . | |
| 3,866,644 | 2/1975 | Stubbs . | |
| 3,933,348 | 1/1976 | Tidwell, Jr. . | |
| 4,015,387 | 4/1977 | Tillie . | |
| 4,154,436 | 5/1979 | Sellers . | |
| 4,165,591 | 8/1979 | Fitzgibbon . | |
| 4,201,020 | 5/1980 | Saunders . | |
| 4,212,110 | 7/1980 | Hill, Jr. . | |
| 4,330,921 | 5/1982 | White, Jr. . | |
| 4,372,050 | 2/1983 | Eisenhauer . | |
| 4,486,996 | 12/1984 | Alejos . | |
| 4,541,618 | 9/1985 | Bruno . | |
| 4,578,914 | 4/1986 | Staples . | |
| 4,637,187 | 1/1987 | Campbell . | |
| 4,641,468 | 2/1987 | Slater | 52/309.7 X |
| 4,641,469 | 2/1987 | Wood . | |
| 4,813,193 | 3/1989 | Altizer | 52/309.7 X |
| 4,875,267 | 10/1989 | Berg . | |
| 4,894,974 | 1/1990 | Mayhew et al. | 52/793.11 X |
| 5,031,886 | 7/1991 | Sosebee . | |
| 5,157,892 | 10/1992 | Ryther | 52/793.11 |
| 5,167,404 | 12/1992 | Weeks . | |
| 5,195,249 | 3/1993 | Jackson . | |
| 5,269,109 | 12/1993 | Gulur | 52/309.7 X |
| 5,323,578 | 6/1994 | Chagnon et al. . | |
| 5,360,212 | 11/1994 | West . | |
| 5,373,674 | 12/1994 | Winter, IV . | |
| 5,381,633 | 1/1995 | Hendrich . | |
| 5,441,379 | 8/1995 | Gilbert, Jr. . | |
| 5,465,545 | 11/1995 | Trousilek . | |
| 5,566,931 | 10/1996 | Considine . | |

FOREIGN PATENT DOCUMENTS

| | | |
|---|---|---|
| 1154245 | 4/1958 | France . |
| 2275944 | 9/1994 | United Kingdom . |

*Primary Examiner*—Christopher Kent
*Attorney, Agent, or Firm*—Wood, Herron & Evans, L.L.P.

[57] ABSTRACT

A method of constructing a building using template-directed prefabricated units. The templates for each unit are grooved according to a design plan. The grooves are sized and positioned for use as alignment guides to accept building components or to define openings, such as doors or windows, in the unit. The building components are positioned in the template, checked and adjusted, if necessary, to ensure they are in square, and fastened to each other. A solid backing is fastened, which comprises the exterior of the completed unit. In one embodiment, the solid backing may be the template itself. The units are transported to the construction site, where they can be immediately assembled and fastened to adjacent units so that the solid backings form the exterior structure of the building.

25 Claims, 4 Drawing Sheets

HOME CONSTRUCTION METHODOLOGY

BACKGROUND OF THE INVENTION

This invention relates to off-site manufacture of prefabricated building units and on-site construction of buildings using the units.

Construction of even a simple building is a multi-step process: a foundation is poured, walls are erected with door and window cut-outs, a roof is built, floors are laid, and exterior covering is added. Since each step is performed on-site, builders are forced to contend with a number of factors beyond their control. Such factors include inclement weather that slows or halts construction, concerns about equipment security and personnel safety, and coordination of properly-skilled workers and proper materials to be at the right place at the right time. It follows, then, that a building method which minimizes or eliminates any variable in any step of the process would increase the builder's efficiency and decrease his or her costs.

In erecting walls of a building, the usual method involves assembling wall studs, headers, and plates, then measuring, aligning, verifying, and nailing them together, followed by overlaying with one-half inch exterior wall sheeting. Since each step is performed on-site, it can be prolonged or delayed by any of the aforementioned variables. For example, rain or snow could make it impossible to work, the assembled raw materials could be stolen, more carpenters could be required than originally calculated, or one carpenter could suffer an injury leaving others to make up the workload.

To facilitate construction, prefabricated panels have been used in the building construction industry. While such prefabricated panels are theoretically useful, they have not been practically successful. A single measurement or cutting error could cause many panels to be out of alignment. Further, depending on the fabrication method used, an error in measuring may be reproduced many times, resulting in inaccurate although similar panels. Measuring, aligning, verifying, and trimming the prefabricated panels may have to be duplicated on-site. This results in increased rather than decreased cost, especially since the required skilled workers may not be available on-site.

SUMMARY OF THE INVENTION

In accordance with the invention, a grooved template is manufactured that will contain wall studs, top plates, and sill plates in proper position. Wall studs, top plates, and sill plates are placed in the grooves and, when properly aligned, are fastened together. A panel backing or, alternatively, the template itself is then fastened to the studs, top plates, and sill plates to form a prefabricated building unit. This prefabricated building unit is then transported to the construction site ready to assemble into a building.

Prefabrication minimizes on-site exposure of building materials to wind, rain, snow, lightning, and temperature extremes. Furthermore, off-site prefabrication allows round the clock construction, if necessary. Builders work under optimal safety conditions and with all necessary tools readily available. Of major importance, the building is constructed in less time, resulting in cost savings to the builder and ultimately to the owner.

One aspect of the present invention is a method of constructing a building using units that have been prefabricated off-site. The units, comprising walls of the building, are constructed using templates and are transported ready-to-assemble. Once on-site, the units are configured according to a design plan and are fastened to each other. In specific embodiments, the templates properly and reproducably position wall studs, top plates, and sill plates for subsequent fixation to each other. The templates may be reused or may become part of the unit itself.

Another aspect of the present invention is the structure of the aforementioned building construction templates. The templates are manufactured to contain any alignment grooves required by a design plan. A related aspect is the method of manufacturing the templates by forming grooves in the material. In specific embodiments, the templates may be manufactured of styrofoam.

A further aspect of the present invention is the use of the template to prefabricate building units off-site. The building units are comprised of wall studs, top plates, and sill plates fastened together. The studs, top plates, and sill plates are positioned in the template, made square, and fastened to each other. In one specific embodiment, a support backing is then fastened to the wall studs, top plates, and sill plates. The template itself may provide the support backing, or a separate panel may be used. The building units are transported to the construction site and arrive ready to assemble with other units to form the building.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
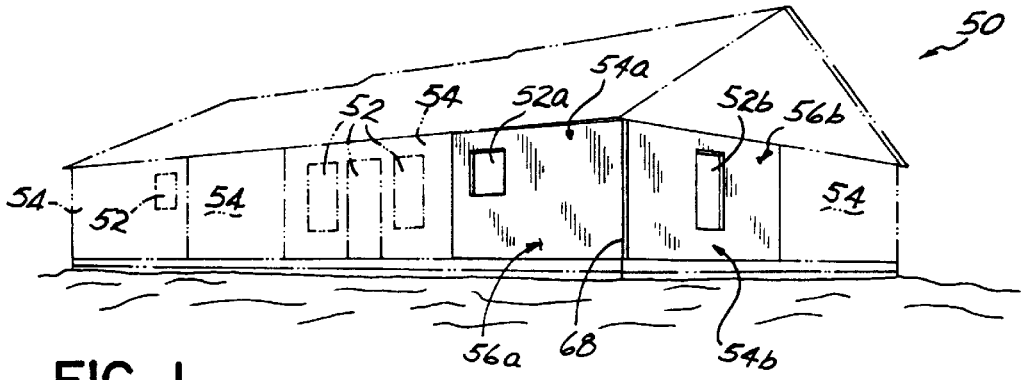
FIG. 1 is a building constructed with prefabricated units.

The present invention relates to a method of constructing a human habitable building 50 from prefabricated building units 54*a*, 54*b* whose construction is template-directed, thus achieving reproducability and accuracy in the dimensions of the unit. The units are manufactured off-site and are transported to the construction site where they are configured according to a design plan and fastened to each other to form part of a building 50. The unit contains any openings 52 such as windows or doors required by the design plan. While FIG. 1 illustrates the units assembled into a house 50, the units are not limited to use in a house, but may be used in buildings such as hotels, motels, apartments, office buildings and the like. The units include a generally rectangular planer member which, upon assembly, will form part of the exterior surface of the building.

Figure 2:
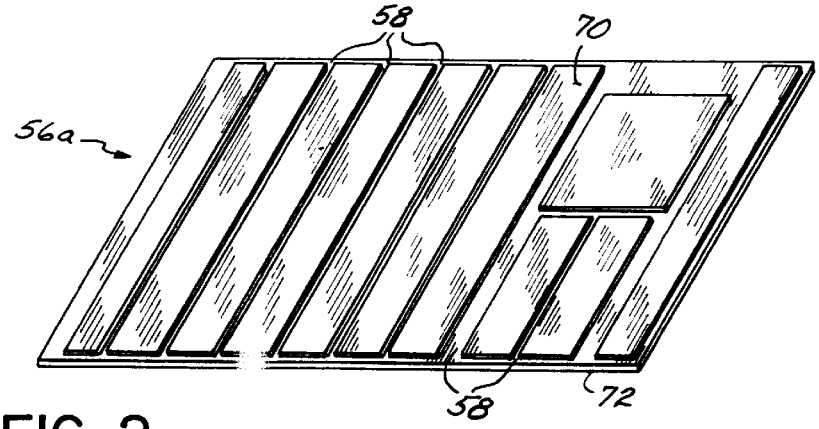
FIG. 2 is a template containing grooves used to construct the building shown in FIG. 1.
Figure 4:
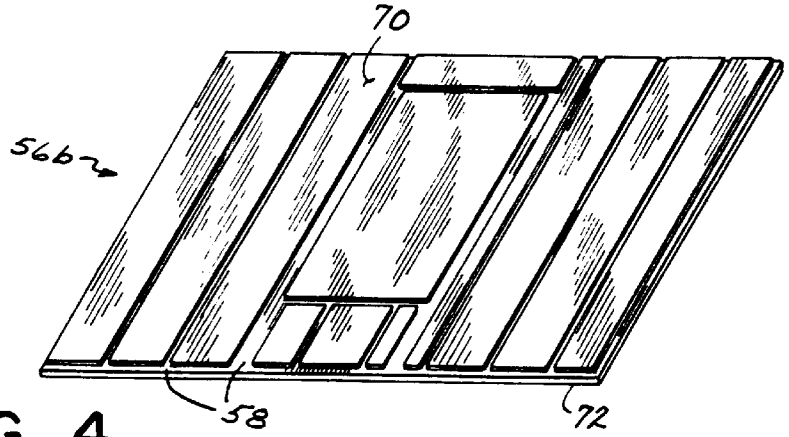
FIG. 4 is another template containing grooves used to construct the building shown in FIG. 1.

The building units 54*a*, 54*b* shown in FIG. 1 were created using the templates illustrated in FIGS. 2 and 4. The templates 56*a*, 56*b* like each unit 54*a*, 54*b* is a generally rectangular planar member containing grooves 58 for subsequent placement of building construction material such as wall studs, top plates, or sill plates. The grooves 58 define the size and position of the construction material and thus define any openings in a particular building unit, for example, the windows 52*a*, 52*b* shown in FIGS. 1 and 2. Because the template defines the exact positions of the building construction materials, variations in measurements of those materials are reduced and reproducability in the dimensions of the unit is improved. Such reproducability in the construction of the building units significantly decreases on-site construction time and procedures and improves the quality of the resulting building. The templates 56*a*, 56*b* can be constructed of any material that can contain the necessary grooves 58 required by a design plan and, in one embodiment, may be constructed of styrofoam.

Figure 3:
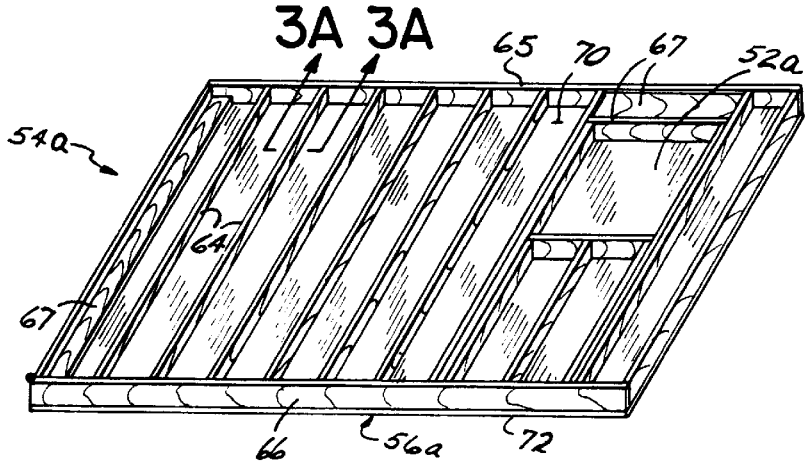
FIG. 3 is a building unit comprised of wall studs, top plates, and sill plates affixed to the template shown in FIG. 2.
Figure 5:
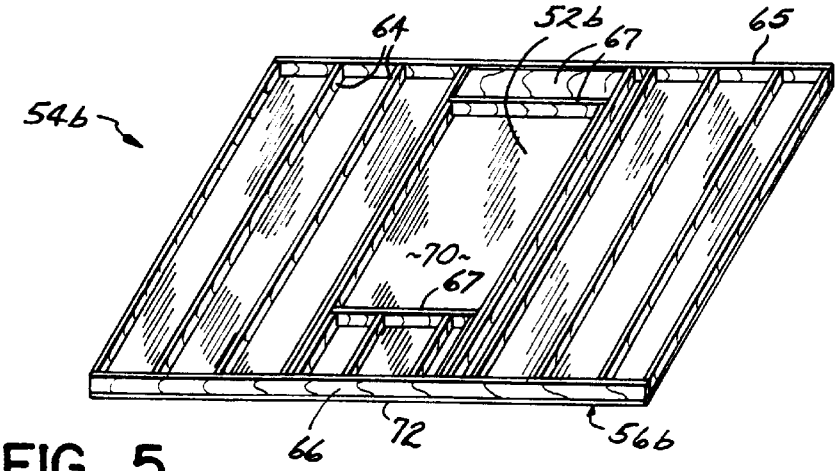
FIG. 5 is another building unit comprised of wall studs, top plates, and sill plates affixed to the template shown in FIG. 4.

The building units 54*a*, 54*b* shown in FIGS. 3 and 5 are used in the construction of the building shown in FIG. 1, and placement of the studs, top plates, and sill plates was directed by the templates shown in FIGS. 2 and 4, respectively. Each building unit 54*a*, 54*b* is made up of studs 64, top plates 65, and sill plates 66 that have been placed in the grooves 58 of a template 56*a*, 56*b* either on their narrow surface (see 64) to comprise the perimeters of the unit and the studs, or on their wide surface as supports 67, such as above the area defined for the window 52*a*, 52*b*, or in the area 68 (FIG. 1) forming the intersection of the two sides of the building 50 to provide additional structural support. The building units 54*a*, 54*b* thus contains the structural studs, headers, and plates reproducably and uniformly positioned. In the usual embodiment, the studs 64, top plates 65, sill plates 66, and supports 67 will be constructed of wood products. The position of the studs, top plates, sill plates, and supports is verified to be in square so that if any realignments are needed, the changes can be made before the individual pieces are fastened to each other to form the fixed unit. The unit 54 is then attached to the styrofoam templates 56*a*, 56*b* shown in FIGS. 2 and 4. The grooved surface 70 of the template thus faces inward into the unit and the nongrooved surface 72 of the template faces outward from the unit and provides a solid panel covering one entire surface of the unit. When the building is ready to be assembled at the construction site, the unit is rotated 180° so that the exterior surface 72 of the template forms the exterior surface of the building 50. The areas defining any openings such as windows or doors 52*a*, 52*b* are cut out after the building has been erected. This minimizes the time the interior of the building under construction is exposed to external elements such as inclement weather or intruders.

Figure 3A:
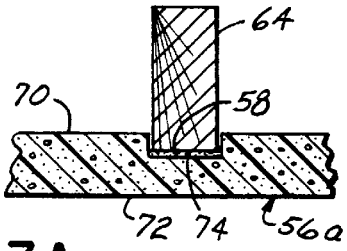
FIG. 3A is a fragmentary sectional view taken along the line of 3A—3A of FIG. 3 showing the manner in which the template is fastened to the stud.

FIG. 3A illustrates fastening of the interior grooved surface 70 of the template 56 to a stud 64 positioned in one of the grooves 58. Hot glue 74 is placed in one of the grooves 58 and the stud 64 positioned in the groove. The hot glue does not immediately set, thereby allow s the stud 64 to be repositioned if necessary. Once set, however, the stud 64 is securely fastened by the hot glue 74 to the styrofoam template 56.

Figure 6:
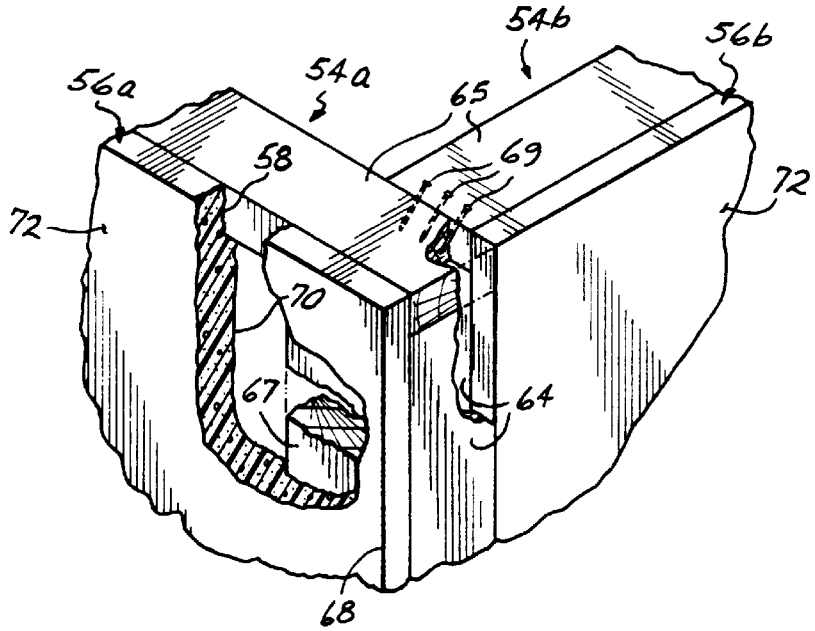
FIG. 6 is a perspective view of a corner intersection of two building units.

FIG. 6 shows how the building unit 54*a* is configured at its intersection with another building unit 54*b*. The top plate 65 of the unit 54*a* is placed in the groove 58 on the template 56*a* that forms the building unit 54*a*. The support 67 (see also FIG. 3) is positioned on the grooved surface 70 of the template to reinforce the area 68 where the units intersect (see also FIG. 1). The edge of the unit 54*b* (defined by the outermost stud 64 of unit 54*b*) abuts to the top plate 65 and outermost stud 64 of the adjoining unit 54*a*. Nails 69 or other fasteners are used to join the units. After joining, only the exterior surface of the templates 72, the top plates 65 and a stud 64 forming the perimeter of the unit 54*a* are exposed.

Figure 7:
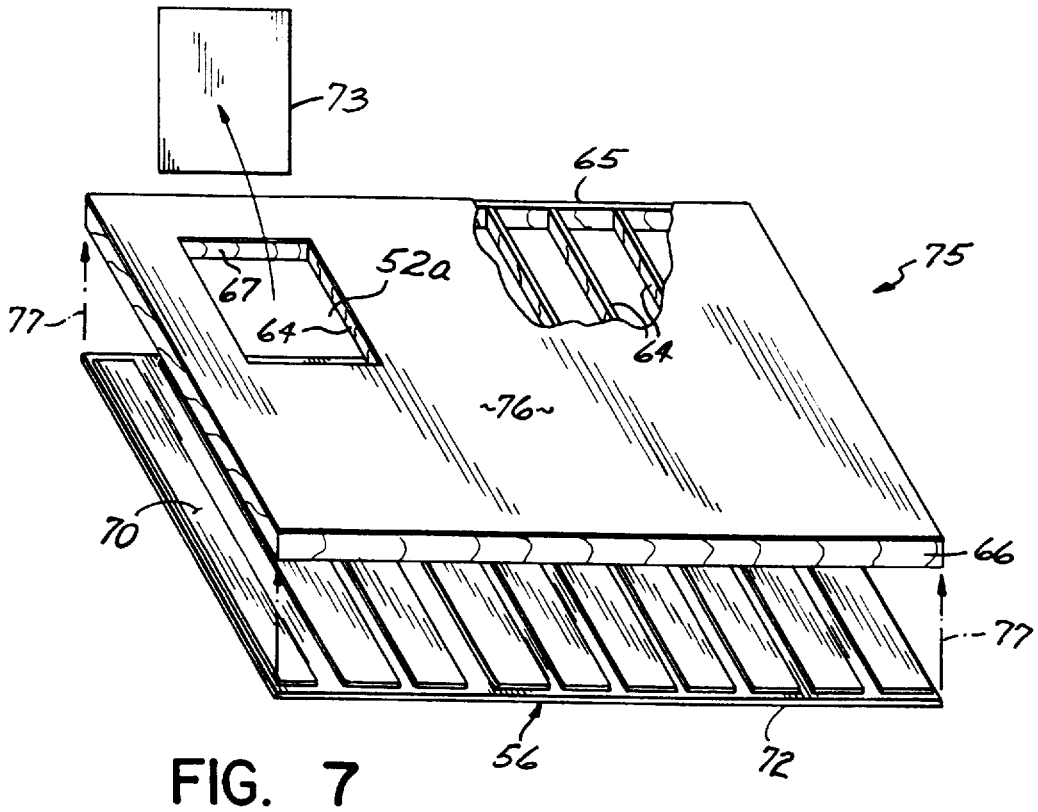
FIG. 7 is an alternative embodiment of the building unit of FIG. 3, comprised of wall studs, top plates, and sill plates affixed to a panel, being removed from its template.

FIG. 7 shows an alternative embodiment of the construction unit 75. As before, a template 56 with a grooved surface 70 directs the positioning of studs 64, top plates 65, sill plates 66, and supports 67. Openings for windows and doors (e.g. 52*a*) are similarly defined. In this embodiment, however, a solid panel 76 is overlaid and is fastened to the studs 64, top plates 65, and sill plates 66 by nailing. Areas defining windows and doors are subsequently cut out before transporting the unit to the construction site (see discarded panel 73). The unit is then lifted from the template, as shown at 77. The template 56 is then reused for construction of another unit, while the completed unit 75 is transported to the construction site. On site, the unit 75 is positioned so that the solid panel 76 comprises the exterior surface of the building 50 shown in FIG. 1.

Figure 8:
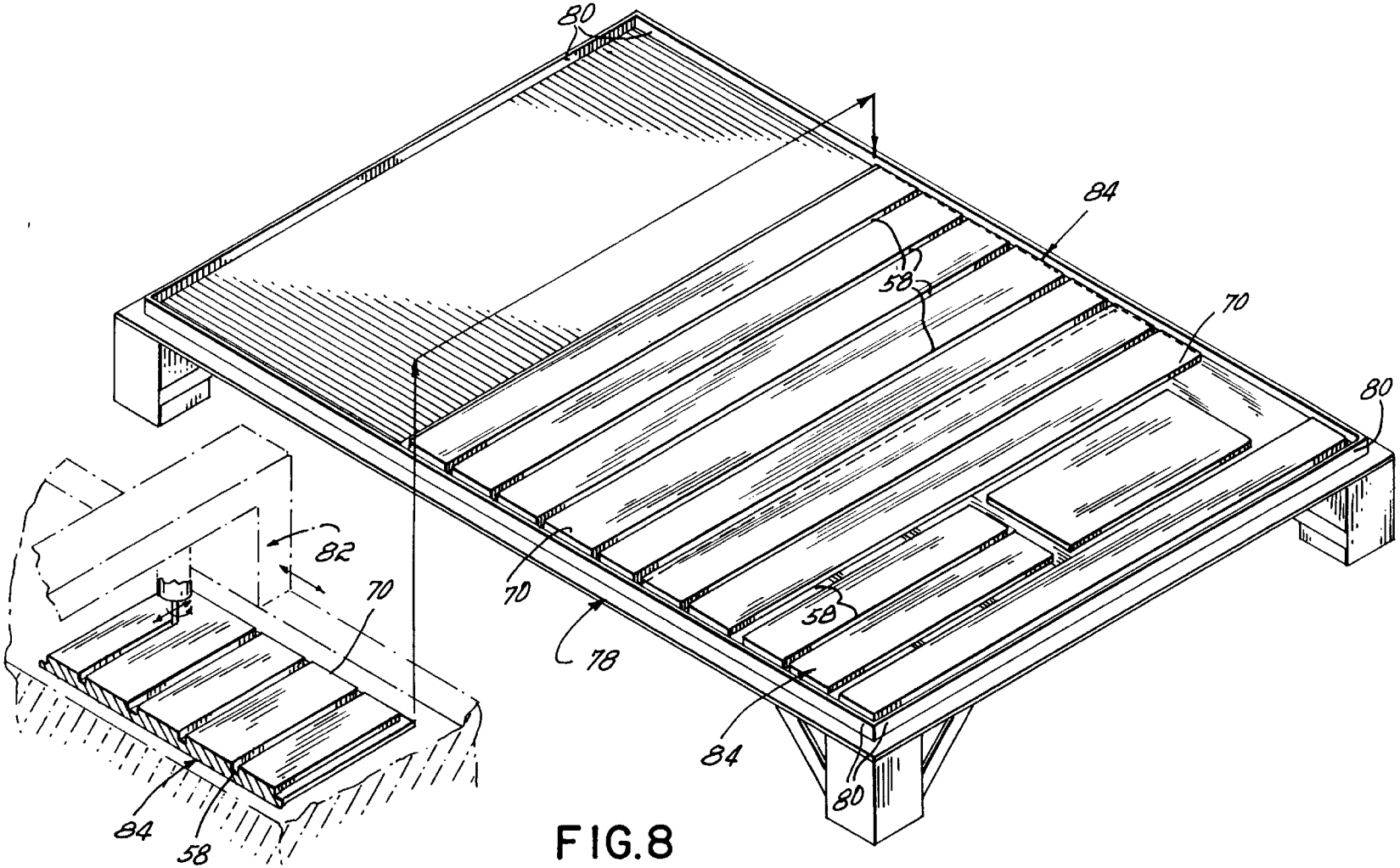
FIG. 8 is the template of FIG. 2 under construction showing a groove being milled by a router.

The construction of the template is shown in FIG. 8. Styrofoam panels 84 are laid on a construction table 78 containing rails 80 that serve as alignment and measuring guides. The grooves 58 in the panel 84 are milled using a computer-controlled router 82. One commercially-available router that might be used for such an application is available from Thermwood of Dale, Ind. as model number 53. The placement of the grooves is according to a design plan generated by a computer-aided design system.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A method of constructing a human-habitable building, comprising the steps of:

providing building components;

providing templates for positioning of said components;

individually positioning off-site said components on said templates and then affixing off-site said components to each other to form prefabricated building units, at least one of said units defining openings for access, ventilation, or aesthetic purposes;

transporting said units to a construction site; and constructing on said site said building by assembling and fastening said units to each other according to a design plan.

2. The method of claim 1 wherein said components are affixed off-site to said templates.

3. The method of claim 2 wherein said units with said affixed templates are transported to a construction site.

4. The method of claim 1 wherein said templates have grooves to facilitate positioning said components.

5. The method of claim 4 wherein said components comprise one or more of wall studs, top plates, or sill plates.

6. The method of claim 5 wherein said wall studs, top plates or sill plates are manufactured from wood products.

7. A method of manufacturing templates to construct walls of a human-habitable building according to a design plan, comprising the step of manufacturing a plurality of substantially planar panels with grooves positioned according to specifications of said plan, wherein said grooves in said panels are sized and positioned for use as alignment guides for acceptance of standard size wall studs, headers, and footers in a non-interlocking configuration such that at every intersection between two or more of said grooves, at least one of the intersecting grooves terminates, said templates defining openings for access, ventilation, or aesthetic purposes according to said design plan.

8. The method of claim 7 wherein at least one of said panels is substantially rectangular along its planar surface and is substantially four feet by eight feet in dimension.

9. The method of claim 7 wherein said panels are manufactured of styrofoam selected from the group consisting of one pound styrofoam, one and one-half pound styrofoam, and two pound styrofoam.

10. The method of claim 7 wherein said manufacturing step comprises milling said grooves into said panels according to specifications of said plan.

11. A method of constructing a prefabricated building unit, comprising the steps of:

providing studs, top plates and sill plates;

providing a template containing grooves sized to receive and position said studs, top plates, and sill plates;

individually positioning said studs, top plates, and sill plates on said grooves of said template; and concurrently verifying said unit is in square;

adjusting if said unit is out of square; and then fastening said studs, top plates, and sill plates to each other at joints to form said units.

12. The method of claim 11 wherein said grooves in said template are one and three-fourths inches wide.

13. The method of claim 11 wherein said template is positioned on a work table containing rails.

14. The method of claim 13 wherein said rails define an area comprising up to approximately eight feet in height and sixteen feet in length.

15. The method of claim 13 wherein said positioning step includes positioning said wall studs, top plates, and sill plates inside said rails of said table to insure correct configuration of said wall studs, top plates, and sill plates.

16. The method of claim 13 wherein said positioning step further comprises fastening said wall studs, top plates, and sill plates to said template, whereby said template forms part of said building unit.

17. The method of claim 16 wherein said fastening step comprises gluing said wall studs, top plates, and sill plates to said template.

18. The method of claim 16 further comprising generating an opening into said template at a location bounded by said wall studs, top plates, and sill plates.

19. The method of claim 11 further comprising positioning a substantially planar building panel on top of said wall studs, top plates, and sill plates, and fastening said panel to said wall studs, top plates, and sill plates whereby said panel forms part of said building unit.

20. The method of claim 19 wherein said panel is selected from the group consisting of lumber and wood products.

21. The method of claim 19 wherein said fastening of said wall studs, top plates, and sill plates to each other comprises gluing said wall studs, top plates, and sill plates to each other.

22. The method of claim 19 wherein said fastening of said wall studs, top plates, and sill plates to each other comprises nailing said wall studs, top plates, and sill plates to each other.

23. The method of claim 19 further comprising cutting an opening into said panel at a location bounded by said wall studs, top plates, and sill plates.

24. A wall panel template to enable prefabrication of a human-habitable building, said template being substantially planar and comprising grooves sized for placement of standard size wood products in a non-interlocking configuration such that at every intersection between two or more of said grooves, at least one of the intersecting grooves terminates, said template defining an opening for access, ventilation, or aesthetic purposes.

25. The template of claim 24 wherein said template is manufactured of styrofoam.

* * * * *

UNITED STATES PATENT AND TRADEMARK OFFICE

CERTIFICATE OF CORRECTION

PATENT NO. : 5,819,498

DATED : October 13, 1998

INVENTOR(S) : Joseph R. Geraci

It is certified that error appears in the above-identified patent and that said Letters Patent is hereby corrected as shown below:

Column 3, Line 64 "allow s" to --allowing--.

Signed and Sealed this

Twenty-third Day of March, 1999

*Attest:*

Q. TODD DICKINSON

*Attesting Officer*

*Acting Commissioner of Patents and Trademarks*